US006000323A

United States Patent [19]

Schlegel

[11] Patent Number: 6,000,323

[45] Date of Patent: Dec. 14, 1999

[54] TRASH COMPACTING METHOD AND APPARATUS

[76] Inventor: Dean J. Schlegel, 4321 Sequoia Dr., Eagan, Minn. 55122

[21] Appl. No.: 09/121,084

[22] Filed: Jul. 23, 1998

[51] Int. Cl.[6] ..... B30B 5/02; B30B 9/30

[52] U.S. Cl. ..... 100/35; 53/526; 100/90; 100/211; 100/226; 100/269.04

[58] Field of Search ..... 100/35, 90, 211, 100/226–228, 229 A, 269.02, 269.03, 269.04; 53/526, 527

[56] References Cited

U.S. PATENT DOCUMENTS

| | | | |
|---|---|---|---|
| 1,405,440 | 2/1922 | Randall et al. | 100/269.02 |
| 1,492,159 | 4/1924 | Caretta . | |
| 2,331,297 | 10/1943 | Bendix . | |
| 2,357,879 | 9/1944 | DeBerg, Jr. . | |
| 2,612,100 | 9/1952 | Bates et al. | 100/211 |
| 3,654,855 | 4/1972 | Longo | 100/269.04 |
| 3,688,689 | 9/1972 | Fierle et al. . | |
| 3,736,863 | 6/1973 | Brucker . | |
| 3,763,773 | 10/1973 | Clay . | |
| 3,835,769 | 9/1974 | Peterson . | |
| 3,899,967 | 8/1975 | Powers . | |
| 3,939,765 | 2/1976 | Jung et al. . | |
| 4,269,114 | 5/1981 | Schwarz et al. . | |
| 4,934,125 | 6/1990 | Baker | 53/527 |
| 5,083,509 | 1/1992 | Hansen et al. . | |
| 5,355,789 | 10/1994 | Suzuki et al. . | |

FOREIGN PATENT DOCUMENTS

| | | | |
|---|---|---|---|
| 329046 | 8/1935 | Italy | 100/211 |
| 8-119401 | 5/1996 | Japan . | |

*Primary Examiner*—Stephen F. Gerrity
*Attorney, Agent, or Firm*—R. C. Baker & Associates, Ltd.

[57] ABSTRACT

A trash compacting apparatus having a flexible, collapsible containment bag formed of substantially non-stretchable wall material, and a flexible, collapsible, expandable bladder having substantially impermeable walls. The bladder is arranged relative to the containment bag for expansion therein in a manner such that the expansive force of the bladder during expansion is confined within the containment bag. The bladder functions to compress any flexible bag of trash housed with the bladder in the containment bag.

23 Claims, 2 Drawing Sheets

TRASH COMPACTING METHOD AND APPARATUS

BACKGROUND OF THE INVENTION

This invention relates to an apparatus for and method of compacting trash, and more particularly to an apparatus and method not critically requiring a rigid, fixed walled compaction chamber.

Prior art trash compactors characteristically have had rigid, fixed walled compaction chambers for use in combination with a displaceable drive assembly, typically a piston or plate, and a drive means such as a mechanical, pneumatic or hydraulic actuator for displacement of the drive assembly. Traditionally both the drive assembly and the drive means have been physically part of or integral to the trash compactor, making for a particularly large, heavy and obtrusive compactor that almost always is used in the home as a "built-in" wall or counter unit.

Yet to be addressed by those skilled in the trash compacting art is the influence of recycling upon the users of trash compactors, and on trash compactor design itself. It is believed that a majority of households currently actively participate in community recycling programs. These programs typically require items such as paper, plastic, aluminum, and glass to be separated from the "other" items of trash that are typically picked up curb side by a waste hauler. As a result, the quantity of trash for compaction in the household setting has been somewhat reduced, and the physical quality of it is becoming relatively less variable. No longer are bulky and obtrusive compactors critically necessary. Instead, the real need now is for a simple and inexpensive, consumer-oriented trash compactor exhibiting lightweight portability and easy use in and about the home, apartment, garage, yard, farm, or business, as the need arises. This invention is directed to such a compactor.

BRIEF SUMMARY OF THE INVENTION

This invention provides a low cost, lightweight trash compacting apparatus of few components, as well as a method of compacting trash using such apparatus. The invention does not require the use of a rigid, fixed-walled compaction chamber, and does not require a multitude of complex cooperating components, subassemblies, and control systems. No special "installation" is required (i.e., only minimal set up is needed). operability is accomplished with low power consumption which permits use of the apparatus and method in a variety of locations in and about the home, apartment, garage, yard, farm or business, as the need arises.

The apparatus of this invention comprises a flexible, collapsible containment bag formed of substantially non-stretchable wall material, and a flexible, collapsible, expandable bladder having substantially impermeable walls. The bladder is arranged relative to the containment bag for expansion therein in a manner such that the expansive force of the bladder during expansion is confined within the containment bag, with the bladder functioning to compress any flexible bag of trash housed with the bladder in the containment bag.

Ideally, the material forming the walls of the containment bag comprises porous material. Preferably the containment bag in non-collapsed condition has the general form of an elongated cylinder. The cylinder ideally includes a base wall and an access opening capable of closure, (as, for example, by a slide fastener). The bladder optionally may be mounted on a closure panel for the access opening.

Preferably the bladder is part of an assembly and includes a conduit for conducting fluid in and out of it for expansion and contraction. The impermeable walls of the bladder may include opposing walls that are forced away from each other during bladder expansion. The bladder may be equipped with an elastic tensioning strap for biasing the opposing walls toward each other. Most preferably the bladder includes a base wall area and a push wall area in opposing relationship. The push wall area should be oriented so as to advance toward any flexible bag of trash housed with the bladder in the containment bag during bladder expansion.

Optionally, the trash compacting apparatus may further comprise a bladder protection plate with or without a buffer pad between the bladder and a bag of trash to be compacted. The buffer pad may function to press against a bag of trash housed with the bladder in the containment bag during the step of bladder expansion, and thus temper any risk of tearing the walls of the trash bag.

The preferred method of the invention comprises forming a trash compacting apparatus having a flexible, collapsible containment bag of substantially non-stretchable wall material, and a flexible, collapsible, expandable bladder having substantially impermeable walls, wherein the containment bag is equipped with a closeable access opening. A flexible bag of trash is arranged within the containment bag, followed by arrangement of the bladder for expansion within the containment bag in a manner so as to compress the flexible bag of trash housed in the containment bag upon expansion of the bladder. The access opening of the containment bag is closed and then the bladder is expanded within the containment bag to compress the flexible bag of trash and compact the trash therein.

Still other features and benefits of the invention will be evident as this description proceeds.

DETAILED DESCRIPTION OF THE INVENTION

Figure 1:
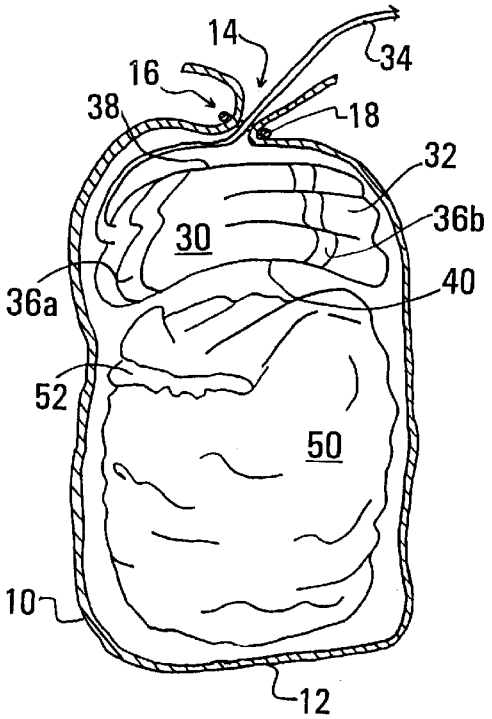
FIG. 1 is a schematic view of the trash compacting apparatus of the invention showing the containment bag in cross section and showing a flexible bag of trash housed inside the containment bag and depicting the bladder in a collapsed and contracted condition ready for expansion in downward compaction.
Figure 2:
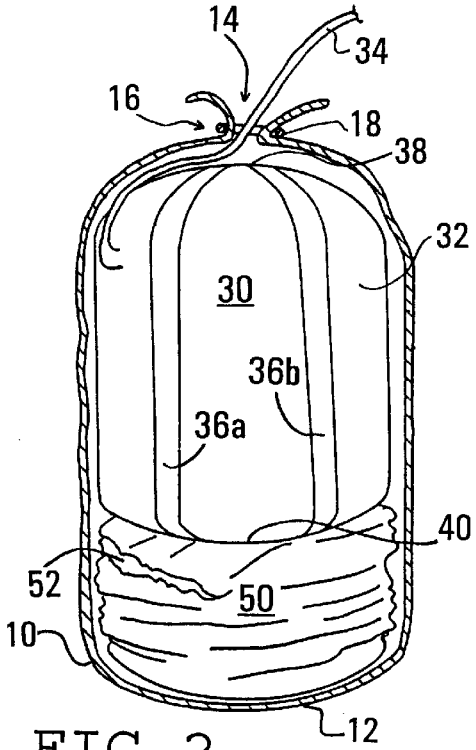
FIG. 2 is a schematic view similar to FIG. 1, but here the bladder is shown expanded in downward compaction of the flexible bag of trash.

Referring particularly to FIGS. 1 and 2, the trash compacting apparatus critically requires a flexible, collapsible containment bag 10 formed of substantially non-stretchable wall material. It also requires a flexible, collapsible, expandable bladder 30 having substantially impermeable walls 32. The bladder 30 is quickly and easily arranged in relation to the containment bag 10 for expansion therein to compress a flexible bag 50 filled with trash confined with the bladder inside the containment bag. It should be understood that the bladder 30 may be arranged in a variety of ways for expansion within the containment bag 10. It may rest on the base wall 12 of the containment bag to substantially occupy the bottom portion of the containment bag, with a flexible bag for trash located thereabove for "upward" compaction as opposed to the "downward" compaction placement of the bladder as depicted in FIGS. 1 and 2.

The containment bag 10 is equipped with an open end or access opening 14 capable of closure. Most preferably the containment bag in a non-collapsed condition has an elongated cylindrical form and includes a base wall 12 and a closeable access opening 14 in opposing relationship. Ideally the containment bag is slightly tapered from a wide or large access opening 14 to a relatively smaller base wall 12 (i.e., the area of the access opening of the containment bag is preferably greater than the area of the base wall) to facilitate loading, unloading, and downward compaction of trash in the trash bag. This taper need not be great and preferably is not. The area of the access opening (when open to its widest extent) preferably is no more than about 10 or possibly 15 percent greater than the area of the base wall. Thus, the generally cylindrical form for the containment bag in non-collapsed condition is retained even though the cylinder is somewhat tapered, and the diameter of the access opening is greater than the diameter of the base wall.

The access opening 14 or mouth of the containment bag may be closed in a multitude of ways one quick, efficient and easy way to accomplish closure is by bunching or twisting the portion of the containment bag near the open mouth 14 so as to form a neck 16, about which a closure 18 is fastened. Since the showings of FIGS. 1 and 2 illustrate a tube-like conduit 34 (for the bladder) through such a neck 16, it is critical that the closure or fastener 18 about the neck be loose enough to not cut off fluid flow to and from the bladder 30 th rough the conduit 34. Nevertheless, it is also critical that the closure 18 about the neck 16 secure the mouth 14 of the containment bag 10 in a substantially closed condition to prohibit the escape or expansion of the bladder 30 beyond the confines of the closed containment bag. It is important that the containment bag substantially and significantly encloses or houses both the bladder and bag of trash in a manner so to accept the expansive force of the bladder during bladder expansion. Although hose clamps having internal dimensions about equal in size to the bladder conduit plus the bunched or twisted neck of the containment bag may be employed, wire wraps or cable ties drawn snugly about the neck without choking the bladder conduit or closing it to the passage of fluids such as air are preferred.

The bladder 30 has substantially impermeable walls 32 that may be formed from a stretchable elastomeric material or a suitable non-stretchable or non-elastomeric material. A tubular conduit 34 for conducting a fluid in and out of the bladder during its expansion or contraction extends from a wall of the bladder. The bladder walls 32 suitably include opposing walls that are forced away and distanced from each other during bladder expansion and are preferably biased or collapsed toward each other when static (i.e., when the bladder is not expanded). Suitable biasing is accomplished in a substantially material way when elastomeric bladder walls are employed, or by otherwise employing one or more elastic tensioning bands or straps 36*a* and 36*b* to maintain the bladder in a collapsed and compact condition when unexpanded.

Most preferably the bladder 30 comprises a base wall 38 area and a push wall 40 area in opposing relation. The push wall 40 area is oriented so to advance toward any bag of trash 50 housed with the bladder 30 in the containment bag during any bladder expansion. Said another way, the base wall 38 area is that portion of the bladder wall most remote from the trash bag 50 when the bladder 30 is arranged relative to the containment bag 10 for expansion therein while the push wall 40 area is that portion of the bladder wall closest to the trash bag 50 when so arranged.

The flexible bag of trash 50 must be enclosed, with the bladder 30, within the containment bag 10 as a preliminary to compaction. Just before compaction, the flexible bag of trash is preferably folded over upon itself near its top end or mouth 52 in a manner to limit or inhibit unwanted emptying or spillage of its contents while nonetheless allowing for air passage or escape from the bag during expansion of the bladder for trash compaction. The desire is to minimize the risk of trash bag rupture or breach due to pressurization during compaction.

Figure 3:
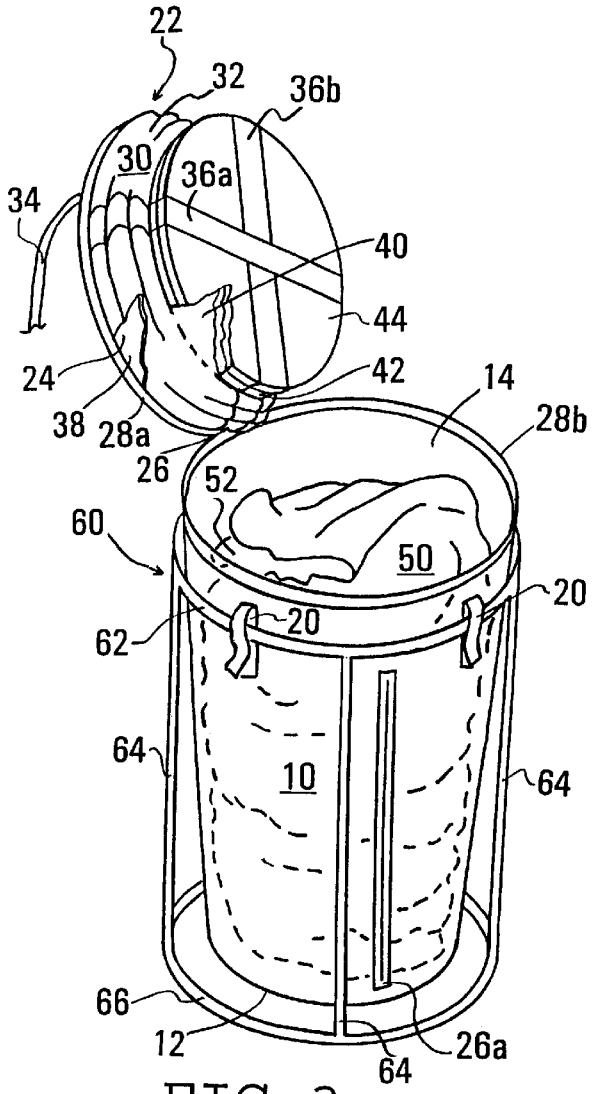
FIG. 3 is a perspective view of a further embodiment, with some parts broken away to view underlying detail, illustrating the trash compacting apparatus in combination with a rigid frame structure for supporting the containment bag and showing a bladder assembly mounted to the closure panel for closing the top access opening of the containment bag.

Referring to FIG. 3, the new flexible trash compacting apparatus may be conveniently supported by a rigid frame support structure 60 having an upper ring or rim 62 on legs 64 extending down to a base foundation or support ring 66. The rigid support structure 60 for the new compaction apparatus may be of various styles but preferably features a rim 62 from which the containment bag 10 is suspended or otherwise engaged in any suitable manner, including draping the containment bag wall adjacent its open end 14 over the rim or upper edge 62 of the support structure 60 (as commonly done for waste basket plastic bag inserts). In FIG. 3, the containment bag features a plurality of top exterior perimeter tabs 20 fixed by sewing or otherwise to the exterior of the containment bag 10. Those tabs 20 are for cooperative engagement with the rim 62 of the support structure 60. The tabs 20 are strip like in nature and may be equipped with hook and loop fastening elements (e.g., VELCRO fasteners). Any suitable fastening elements may be employed. The tabs or strips 20 are simply looped about or otherwise secured to or about the rim 62.

The containment bag 10 illustrated in FIG. 3 has an assembly 22 comprising a closure or cover panel 24 for the access opening of the containment bag from which the bladder 30 may depend or be mounted. Indeed, the closure panel 24 for the containment bag 10 may be integrated with (i.e., be the same as) the base wall 38 of the bladder 30, and in such an arrangement the bladder base wall itself in essence is substantially non-elastic or non-stretchable. Furthermore, in this instance, the closure panel 24 of the containment bag is substantially non-porous and impervious since it is part of the bladder 30. This is perfectly satisfactory for the cover panel portion of the containment bag assembly since air passage through the cover panel itself is inherently blocked by the bladder in this arrangement (as well as in many other arrangements). A slide fastener system 26 such as a zipper may be used to close the panel over the access opening.

Also illustrated in FIG. 3 is a bladder protection plate 42 and a buffer pad 44. Both the protection plate 42 and the buffer pad 44 may be integral to or physically joined with the bladder (i.e., at the push wall 40 area) as part of a bladder assembly 22 as shown in FIG. 31 and may even be joined (i.e., adhered or otherwise fastened) to each other. A loose independent arrangement of these elements relative to each other and the other apparatus elements also is satisfactory. The protection plate 42 functions to shield the expandable bladder from any piercing action by trash during expansion, while the buffer pad 44 functions to cushion bladder engagement against any flexible bag of trash during compaction. In effect, the buffer pad minimizes tears or abrasions of the flexible bag of trash by its interior contents during compaction. The bladder protection plate 42 is arranged so as to be between the bladder 30 and the buffer pad 44, when a buffer pad is used.

The closure panel 24 for the containment bag in FIG. 3 is dimensioned to be in substantial conformity with the access opening 14 of the containment bag 10. Depending from, mounted or otherwise affixed to the panel 24 is the flexible, collapsible expandable bladder 30 having impermeable walls 32, a tubular conduit 34, and one or more elastic tensioning straps 36*a* and 36*b*.

The closure panel 24 of FIG. 3 is equipped with a first set 28*a* of interlocking members of a slide fastener 26 about its perimeter edge for engagement with a second set 28*b* of interlocking members of the slide fastener 26 carried about the top perimeter edge of the access opening or mouth 14 of the containment bag 10. Prior to bladder expansion for trash compaction, the closure panel 24 is conveniently secured to the access opening 14 by slide fastener 26 in a manner such that the expansive force of the bladder during expansion is confined within the containment bag and functions to compress the flexible bag 50 of trash therein. If desired, a second slide fastener 26*a* may be incorporated lengthwise of the containment bag 10. Such a slide fastener permits the compacted flexible trash bag 50 to be quickly and easily removed from the containment bag—even before complete bladder deflation—without lifting the bag up and out through the mouth 14 of the containment bag.

Figure 4:
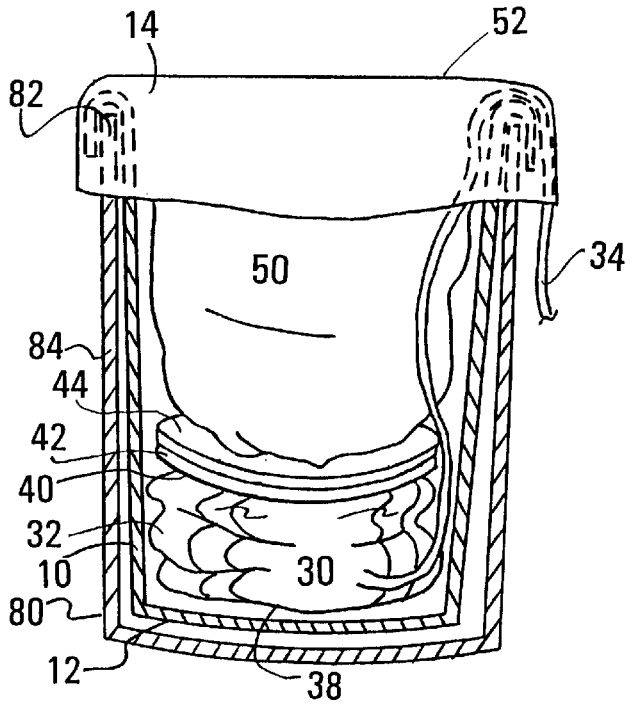
FIG. 4 is a schematic view of a still further embodiment showing the containment bag and a rigid garbage can in cross section, with the open end of the containment bag draped over the upper rim of the garbage can, and particularly illustrating a bladder below an open flexible garbage bag draped over the draping of the open end of the containment bag.
Figure 5:
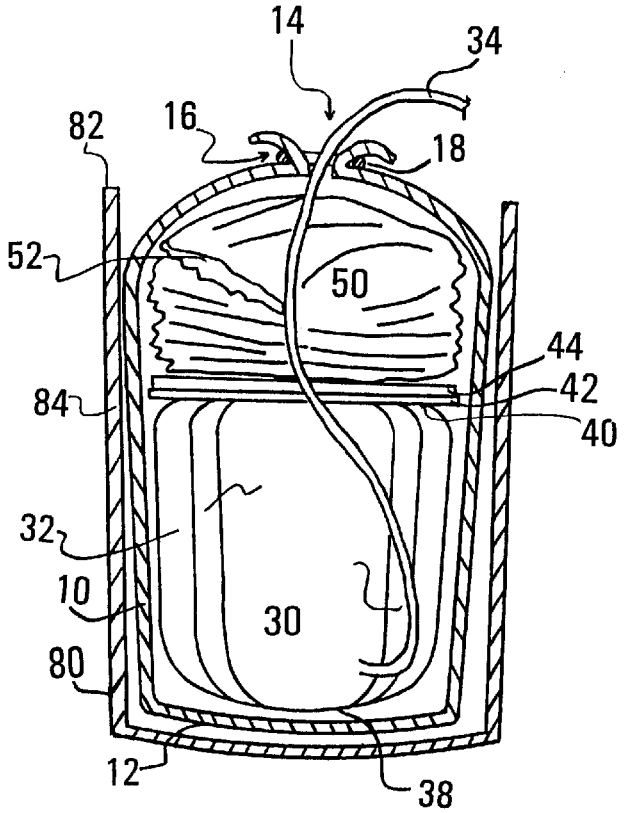
FIG. 5 is a schematic view similar to FIG. 4, but here the bladder is shown expanded in upward compaction of the flexible garbage bag containing trash.

Referring to FIGS. 4 and 5, the trash compacting apparatus is shown in combination with a different type of rigid support structure 80, but one also characterized as having an upper rim 82. A standard circular rigid walled household trash receptacle (i.e., garbage can) exhibits such a feature. Here, the containment bag 10—shown having a fixed uniform shape even though it is flexible, collapsible and lacks rigidity—includes a base wall 12 and a closeable access opening 14. Here bladder 30 is arranged for expansion in an upward compaction stroke and is shown having a duct or tubular conduit 34 extending from a location proximal to its base wall 38 to a location exiting the mouth or access opening 14 of the containment bag 10. (If desired a hole for the tubular conduit 34 could be placed through a containment bag wall at a location near the connection of the conduit to the bladder.) The bladder 30 suitably may be equipped with one or more elastic tensioning straps 36*a* and 36*b*. Also, if desired, a bladder protection plate 42 and a buffer pad 44 having features afore discussed may be employed.

When a rigid receptacle 80 is used as illustrated in FIGS. 4 and 5, the capacity of the closed or substantially sealed containment bag 10 should normally be no larger than and preferably less than the capacity of the receptacle so that the containment bag and not the receptacle bears the brunt of the expansive force exerted by the bladder during compaction operations.

In practice, as illustrated in FIG. 4, the open end or mouth 14 of a containment bag 10 may be rolled or draped over the top perimeter edge or rim 82 of the rigid trash receptacle 80. In this way, the containment bag depends or is suspended from the rim of the receptacle optionally, hook and loop fasteners (e.g., such as those identified by the trademark VELCRO) may be used to retain the top portion of the containment bag 10 in a relatively vertical or upright position within the rigid exterior wall 84 of the trash receptacle 80. Another option is to fix cooperative hook and loop fastener elements (by adhesive, stitching or other suitable means) to the inner side of the top perimeter edge or rim 82 of the trash receptacle 80 and about the exterior perimeter of the containment bag near its access opening—all in a manner that will permit the containment bag to vertically cling to the interior of the receptacle (and possibly also allow the open mouth to be rolled over the rim or upper lip edge of the receptacle.)

A flexible bag for trash 50 is located inside the containment bag 10 and, similar to the upper portion of the containment bag, has its mouth or lip portion 52 rolled or draped over the rim 82 of the receptacle 80 in a manner as illustrated in FIG. 4, for receipt of trash.

After a volume of trash is collected in the trash bag 50, and prior to bladder expansion, the mouth of the flexible trash bag 52 is folded over upon itself as illustrated in FIG. 5 (and as aforementioned in describing FIG. 2). Then the containment bag 10 at its mouth or access opening 14 is bunched or otherwise gathered in a manner to form a neck 16 through which the tubular conduit 34 passes (see FIG. 5) without substantial constriction and about which a closure 18 is attached. Then follows the expansion of the bladder as illustrated in FIG. 5.

In all embodiments, the conduit for fluid passage for bladder expansion is preferably equipped with a connector of any varied but effective type for connection to or interface with a pressurized fluid source. Probably the most simple fluid source is a small household or utility air compressor. The fluid source may vary at will and is an independent discrete element easily separated from the key trash compactor features of the invention.

The method of compacting trash according to the invention has as its first step that of forming a trash compacting apparatus having the features afore discussed, specifically a containment bag and bladder at a minimum. A flexible bag of trash is arranged in the containment bag. Preferably the flexible bag of trash has its top portion folded over upon itself toward a side so as to effectively place the mouth of the trash bag beyond contact with the push wall area of the bladder during expansion to thereby provide an air exhaust or ventilation pathway from the bag of trash during bladder expansion. The air exhaust prevents the creation of a back pressure in the trash bag. This permits a more effective and efficient bladder expansion and also reduces the chance of trash bag rupture and clean up.

Another process step is to arrange the bladder for expansion in the containment bag so to compress the flexible trash bag housed in the containment bag. This step may precede or be subsequent to the step of arranging the flexible trash bag in the containment bag. Thus, the steps of the process are such that they are not limited to one sequence. In arranging the bladder, the push wall of the bladder is preferably oriented for movement toward the flexible trash bag as the bladder is expanded. The tubular conduit is positioned to extend to the outside of the containment bag. Whether this is done by passing the conduit through the mouth of the containment bag or through a special opening in the wall of the containment bag is a matter of discretion by the user. If the arrangement chosen is as illustrated in FIGS. 1 and 2 or in FIG. 3, a "downward" bladder compaction stroke will result. If the configuration is as illustrated in FIGS. 4 and 5, an "upward" compaction will result. When the conduit for the bladder is to be passed through the access opening of the containment bag, the portion of the containment bag proximal to the access opening or mouth is drawn together along with the extending tubular stem or conduit of the bladder by bunching or twisting to form a neck about which a fastener is applied. The tubular conduit extending from the bladder housed within the containment bag is then connected to an external fluid pressure source for expansion. The bladder is then expanded within the containment bag to compress the bag of trash therein.

The new method of trash compacting further contemplates the optional use of such elements as the bladder protection plate and the buffer pad aforementioned with functional performance of each as previously discussed.

The containment bag of the new apparatus is preferably dimensioned to house flexible bags for filling with trash which have capacities ranging generally from 10 to 30 gallons (38–114 liters), but may embrace capacities outside this range with no significant deviation in function or principle of operation. A small volume containment bag (i.e., 15 gal. (57 L)) is ideally suited for use in the kitchen, whereas a larger volume containment bag (i.e., 30 gal. (114 L)) is better suited for garage, yard or business applications.

A round or cylindrical form for non-collapsed containment bags is preferred for the reason that a cylindrical form is the natural state for containing the pressures during compaction.

The access opening or mouth of the containment bag should have a diameter of at least about 18 inches (46 centimeters), with a 24-inch (61 cm) mouth diameter dimension ideally suited for most applications in and about the home or apartment, and even greater mouth diameters such as 36 inches (92 cm) or more are useful for more heavy duty applications. The length of the containment bag (i.e., the distance from its base wall to its access opening or mouth) should be no less than its mouth dimension, and for most practical purposes, the length of the containment bag should be from about one up to about three times greater than its mouth diameter dimension.

In addition to being flexible and collapsible, the containment bag is substantially non-expandable or non-yielding. Preferably the containment bag is formed from a non-stretchable material, and ideally it is formed from a porous material. In all its forms and styles, it is critical that the containment bag be capable of accepting and confining the expansive force of the bladder during any bladder expansion.

The containment bag is ideally constructed of a woven fabric such as canvas (e.g., a fabric made from hemp, flax, jute, or other natural or synthetic fiber). Woven, substantially non-stretchable polymeric material is useful. Fibers of nylon and polyesters can be used to form the material of the containment bag. Preferably the fabric has a fineness of 50–100 grams per 9,000 meters of it (i.e., 50–150 denier). The weave of the containment bag walls is such as to allow easy passage of air and other gases therethrough. Porous walls are critical. Durable containment bags easily washed by hand or machine are most desirable. Suitable containment bags may be formed from fabric weaves that are mesh or net like. It is critical only that the containment bag be porous and exhibit a wall strength capable of containing the expansive force of the bladder. Having noted this, it is preferred, when the porosity of the containment bag is gained by using an open mesh or apertured walls, that the mesh size or apertures in the walls be dimensioned such that portions of the bladder or flexible bag of trash are not capable of forced passage therethrough to any substantial extent during bladder expansion for trash compaction. In this respect, apertures or mesh openings of greater area size than about one square centimeter for the containment bag are generally undesirable even when relatively thick-walled bladders and trash bags are employed. For best results, containment bag mesh openings should not exceed about 25 square millimeters in area (e.g., 0.5 centimeter square openings). Containment bags made of canvas-type fabrics are ideal.

Although the containment bag may be of a seamless tube construction, with a base wall sewn to the tube, suitable economical fabrication is accomplished by joining individual parts or panels together by sewing or other techniques. Because the containment bag is intended to accept and confine the expansive force of the bladder, it is preferable that any seams in the containment bag be reinforced.

Although illustrated with the closeable access opening in an upward direction, the unusual nature of the invention permits easy orientation of the containment bag in any direction during compaction operations, even with the closed access opening lowermost.

The flexible, collapsible and expandable bladder is the drive assembly of the trash compacting apparatus. The bladder may be of varied shapes or styles (i.e., oblong, pillow like, etc.) and illustratively may possess the form of a collapsed, compacted cylinder having a circular cross-sectional area in substantial conformity with the circular cross-sectional area of the containment bag. The bladder expands preferably along a substantially longitudinal direction away from its base wall along its collapsed length (i.e., perpendicular to its cylindrical walls). A bladder of substantially non-stretchable material is flattened or collapsed by using small folds of accordion nature in its side walls (i.e., in the cylindrical wall of the bladder collapsed by the elastic tension straps when not expanded by internal pressure fluid). Elastic walled bladders of natural or synthetic rubber (e.g., butyl or some other rubber) need not be equipped with special tension straps since the wall material of such bladders tends to retract when expansion forces are withdrawn. Elastomeric material of a great variety may be employed as bladder walls. Highly resilient elastic (e.g., natural or synthetic rubber) walls are most preferred, but are not critical for successful practice of the invention. Non-resilient and substantially non-stretchable walls are economical and useful (especially when tension straps are also employed). In general, while the size relationship between an expanded bladder and its containment bag can vary and is dependent to some extent on the bulk of trash being compacted, the maximum expansion size for useful bladders may be as low as one-half of the capacity of its containment bag, but will generally approach about two-thirds of the containment bag's capacity, and may even approach an occupancy as high as three-quarters of same.

An illustrative collapsible and flexible bladder of non-stretchable and non-resilient character may be constructed using an 8 mil (204 micron) vinyl coated polyethylene film-like sheeting. Other acceptable substantially non-stretchable construction materials for a bladder include but are not limited to flexible plastic sheet materials formed of polyethylene terephthalate (i.e., MYLAR), polyvinyl chloride, and other plastic polymeric materials exhibiting substantial imperviousness to the passage of air. The bladder may be an assemblage of panels joined and preferably reinforced by methods readily known to those skilled in such art. A generally cylindrical bladder of 8 mil (204 micron) vinyl coated polyethylene is optimally expanded when pressurized to about 20–30 pounds per square inch gage (psig) using an external pressurized air source. A bladder thickness in excess of 12 mil (305 micron) is economically less attractive, but still useful, whereas a thickness of 6 mil (153 micron) or less preferably warrants the use of a bladder protection plate for shielding the bladder during expansion. Such a plate also functions to equalize the expansive force of the bladder upon the contact surface of the bag of trash.

The bladder protection plate suitably may be formed of plastic material of varied nature. A polyethylene plate or panel having a smooth finish and a thickness of between 1/32 and 1/8 inches (0.08–0.32 cm) is quite useful and economical. Preferably the plate is sized to encompass at least the push wall area of the bladder and is ideally circularly shaped so to be in substantial conformity with containment bag circular cross section. For containment bags of tapered design, the circular shape for this plate should have a diameter approaching but less than (e.g., about 5 percent less than) the diameter of the containment bag at about mid-way between its ends.

To minimize puncturing or other breaches of the flexible bag of trash, the apparatus may further include a buffer pad or cushion for engaging any flexible bag of trash during bladder expansion. Preferably the buffer pad is about 1/8 to 1/2 inch (0.3–1.3 cm) thick, and is formed from crushable but recoverable material (e.g., material having some resiliency) such as natural or synthetic rubber, especially of foamed or porous rubbery materials.

The opposing end walls of the bladder (i.e., the base and push walls of the bladder) are suitably biased toward each other by elastic material (which may be inherently present when elastic bladder walls are employed) such as one or more elastic tensioning straps. Illustratively, a strap of such character may be mounted at one end to a side of the base wall of the bladder and extend to the push wall of the bladder (and pass across the outside face of the push wall and be tacked to the push wall) and then extend back to the base wall and be fastened at the side of the base wall diametrically opposed to the point at which the first end of the strap was mounted or fixed to the base wall. The sought after biasing effect may alternately be achieved using a plurality of elastomeric straps (e.g., segments) disposed about the walls of the bladder to vertically connect or link the base wall to the push wall. Strap members retain the bladder in a collapsed, contracted, and compact condition when unexpanded and facilitate contraction after bladder expansion. During bladder expansion by an external pressurized air source, elastic tension straps joining the opposing ends of the bladder are stretched to accommodate the bladder expansion. Without a continuing pressurized air supply, the expanded bladder loses pressure and volume, and the elastic tensioning straps contract from an extended condition, resulting in the bladder resuming its collapsed and compact condition. The biasing function of the elastic tensioning straps maintain the bladder in a collapsed, contracted, and compact condition that makes for easy handling and stowage between trash compaction operations.

The conduit for the bladder is preferably but not necessarily positioned proximal to the base wall of the bladder and extends outward therefrom in a manner so as to be easily accessible from outside the containment bag for connection to an external drive means, preferably a rotary air compressor equipped with a pressure switch capable of delivering air in the range of 10–50 psig. Tubular conduits of plastic or rubber (natural or synthetic) are useful. The function of the conduit is that of a passageway for ingress and egress of fluid, and the preferred fluid is air. The purpose of the conduit is to link the integral drive assembly (i.e., bladder) to the remote drive system (e.g., air compressor). Tubular conduits should have a diameter between 1/4 and 3/4 inches (0.6–1.9 cm), and readily connect to and accept the air pressures for compaction. If desired, the conduit connection to the bladder may permit a repeated separation and connection to the bladder. Thus, useful bladders may be equipped with a nozzle for receiving a conduit. A valve in the conduit line to the bladder is unnecessary but is a possible option.

The style of flexible trash bag for compaction in this apparatus is highly variable. Bag construction materials may include paper; however, more durable bags such as those of plastic (e.g., polyethylene) are more appropriate or advantageous. Bags having capacities of 13–30 gallons (49–114 L) are preferred. A 13 gallon (49 L) bag is typically dimensioned 2'×2'-5 3/8"×0.7 mil (61 cm×74.6 cm×17.8 micron) whereas a 30 gal. (114 L) bag is generally dimensioned 2'-6"×2'-10"×1.1 mil (76.2 cm×86.4 cm×28 micron).

Further, those skilled in the art will readily recognize that this invention may be embodied in still other specific forms than those illustrated without departing from the spirit or essential character of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

That which is claimed is:

1. A trash compacting apparatus comprising a flexible, collapsible containment bag formed of substantially non-stretchable wall material, and a flexible, collapsible, expandable bladder having substantially impermeable walls, said bladder being arranged relative to said containment bag for expansion therein in a manner such that the expansive force of said bladder during expansion is confined within said containment bag and functions to compress any flexible bag of trash housed with said bladder in said containment bag.

2. The apparatus of claim 1 wherein said wall material of said containment bag comprises porous material.

3. The apparatus of claim 1 wherein said containment bag is equipped with a closeable access opening.

4. The apparatus of claim 1 wherein said containment bag in non-collapsed condition has the general form of an elongated cylinder with opposing ends.

5. The apparatus of claim 4 wherein one said opposing end of said containment bag comprises a base wall and the other said opposing end of said containment bag comprises a closeable access opening.

6. The apparatus of claim 4 wherein said elongated cylinder form of said containment bag tapers in an expanding manner from one said opposing end having a base wall to the other said opposing end having a closeable access opening, said opposing end having an access opening being of greater area than said base wall opposing end.

7. The apparatus of claim 1 wherein said bladder is equipped with a conduit connection for conducting a fluid in and out of it.

8. The apparatus of claim 1 wherein said walls of said bladder comprise elastic material.

9. The apparatus of claim 1 wherein said walls of said bladder comprise a substantially non-stretchable material.

10. The apparatus of claim 1 wherein said walls of said bladder include opposing walls that are forced away from each other during bladder expansion.

11. The apparatus of claim 1 wherein said walls of said bladder include opposing walls that are forced away from each other during bladder expansion and wherein said bladder further comprises an elastic tensioning strap for biasing said opposing walls toward each other.

12. The apparatus of claim 1 wherein said bladder further comprises a base wall area and a push wall area in opposing relationship, said push wall area being oriented to advance toward any flexible bag of trash housed with said bladder in said containment bag during bladder expansion.

13. The apparatus of claim 1 wherein said containment bag in non-collapsed condition has the general form of an elongated cylinder and wherein said bladder further comprises a base wall having a substantially circular area and a push wall having a substantially circular area, said base wall and said push wall being in opposing relationship, said push wall area being oriented to advance toward any flexible bag of trash housed with said bladder in said containment bag during bladder expansion.

14. The apparatus of claim 1 further comprising a bladder protection plate between said bladder and any flexible bag of trash housed with said bladder in said containment bag.

15. The apparatus of claim 14 wherein said protection plate is attached to said bladder.

16. The apparatus of claim 1 further comprising a bladder protection plate and a buffer pad between said bladder and any flexible bag of trash housed in said bladder in said containment bag, said bladder protection plate being more proximate to said bladder than said buffer pad.

17. The apparatus of claim 1 wherein said containment bag is equipped with an access opening closeable by a slide fastener.

18. The apparatus of claim 1 wherein said containment bag includes an access opening and an assembly comprising a closure panel from which said bladder depends.

19. The apparatus of claim 1 in combination with a rigid support structure having,an upper rim and wherein said containment bag is equipped with a closeable access opening, said containment bag being engaged to said rim at a location proximate to said access opening so as to cause said containment bag to be suspended from said rim.

20. The apparatus of claim 1 wherein said containment bag is equipped with an access opening lacking features for closure except by bunching or twisting the portion of the containment bag near said access opening.

21. The apparatus of claim 1 additionally comprising a rigid receptacle within which said containment bag is located.

22. A method of compacting trash comprising the steps of i. forming a trash compacting apparatus having a flexible, collapsible containment bag of substantially non-stretchable wall material, and a flexible, collapsible, expandable bladder having substantially impermeable walls, said containment bag being equipped with a closeable access opening, ii. arranging a flexible bag of trash in said containment bag, iii. arranging said bladder for expansion in said containment bag in a manner so to compress said flexible bag of trash housed in said containment bag upon expansion of said bladder, iv. closing said access opening of said containment bag, and v. expanding said bladder within said containment bag to compress said flexible bag of trash within said containment bag and compact the trash therein.

23. The method of claim 22 wherein said bladder of said trash compacting apparatus is equipped with a conduit for conducting a fluid in and out of it, said method further comprising the step of connecting said conduit to a pressure source for expansion of said bladder.

* * * * *